US012076613B2

(12) United States Patent
Sarmento

(10) Patent No.: US 12,076,613 B2
(45) Date of Patent: Sep. 3, 2024

(54) ELLIPTICAL CRAWLER DEVICE AND METHODS

(71) Applicant: Joao Herberto Sarmento, Half Moon Bay, CA (US)

(72) Inventor: Joao Herberto Sarmento, Half Moon Bay, CA (US)

( * ) Notice: Subject to any disclaimer, the term of this patent is extended or adjusted under 35 U.S.C. 154(b) by 189 days.

(21) Appl. No.: 17/896,358

(22) Filed: Aug. 26, 2022

(65) Prior Publication Data

US 2023/0133935 A1 May 4, 2023

Related U.S. Application Data

(60) Provisional application No. 63/274,712, filed on Nov. 2, 2021.

(51) Int. Cl.
*A63B 22/00* (2006.01)
*A63B 71/06* (2006.01)

(52) U.S. Cl.
CPC ..... *A63B 22/0076* (2013.01); *A63B 71/0622* (2013.01); *A63B 2022/0041* (2013.01); *A63B 2022/0084* (2013.01); *A63B 2071/0675* (2013.01)

(58) Field of Classification Search
CPC ..... A63B 22/0664; A63B 2022/067; A63B 2022/0676; A63B 2022/0682; A63B 22/0076; A63B 2022/0082; A63B 2022/0084; A63B 2022/0087
See application file for complete search history.

(56) References Cited

U.S. PATENT DOCUMENTS 6,077,197 A * 6/2000 Stearns ..... A63B 22/0664 482/52
6,547,701 B1 * 4/2003 Eschenbach ..... A63B 22/001 482/64
9,498,674 B2 * 11/2016 Zhou ..... A61B 5/222
2009/0105050 A1 * 4/2009 Mayo ..... A63B 21/0618 482/70
2010/0248919 A1 * 9/2010 Zhou ..... A63B 22/203 482/139
2012/0244998 A1 * 9/2012 Rao ..... A63B 23/03575 482/70
2015/0141210 A1 * 5/2015 Hall ..... A63B 21/00185 482/56
2015/0151158 A1 * 6/2015 Ellis ..... A63B 21/159 482/142
2015/0283425 A1 * 10/2015 Zhou ..... A63B 22/0005 482/56
2023/0337830 A1 * 10/2023 Raiszadeh ..... A47C 7/38
2024/0123279 A1 * 4/2024 Ellis ..... A63B 22/001

* cited by examiner

*Primary Examiner* — Zachary T Moore

(74) *Attorney, Agent, or Firm* — Taylor English Duma LLP

(57) ABSTRACT

The present disclosure provides an elliptical crawler. The elliptical crawler includes a front support having an adjustable height and an assembly of elliptical rowing body having two extendible arm supports and two foot supports. Methods of making and using the elliptical crawler are also disclosed.

20 Claims, 2 Drawing Sheets

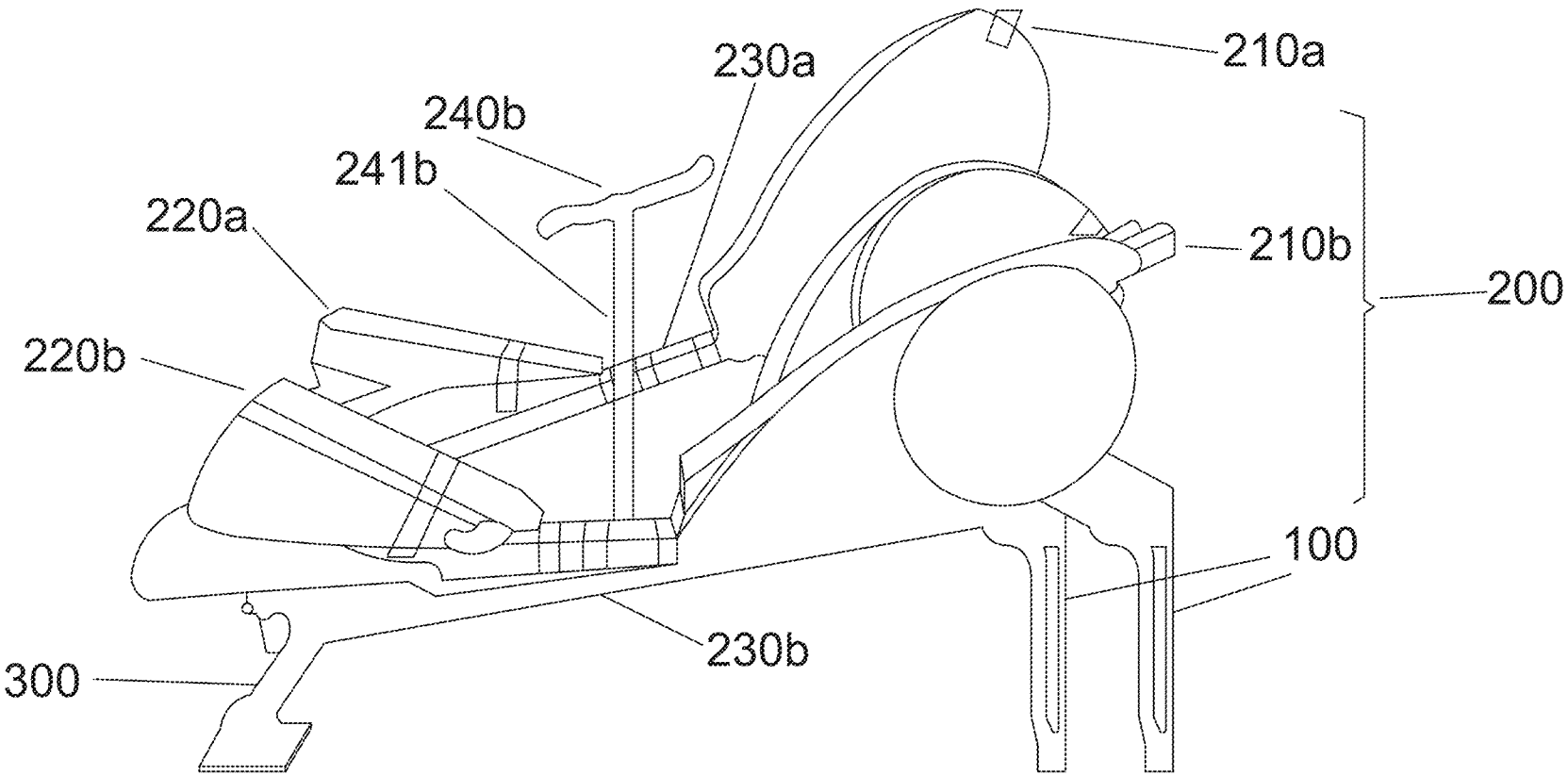
F1G.1

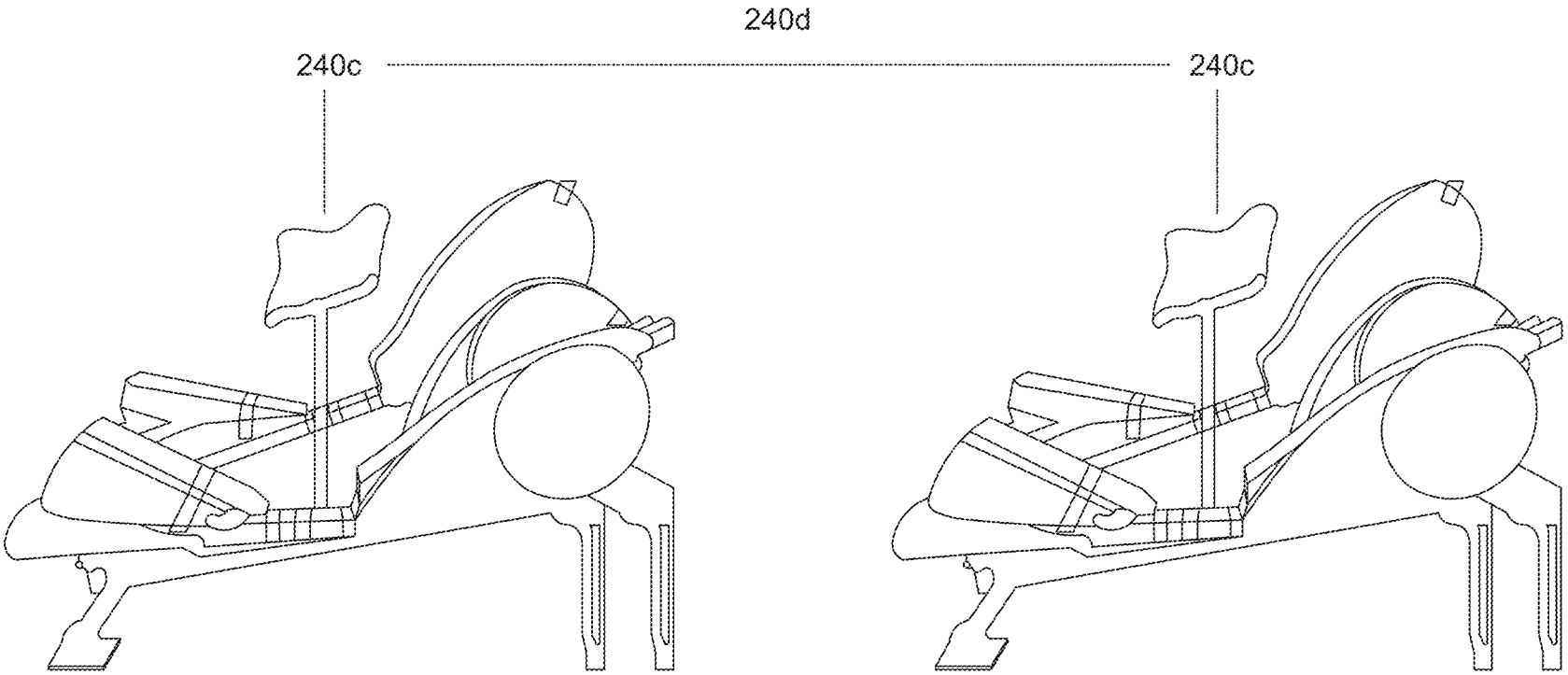
F1G.2

ELLIPTICAL CRAWLER DEVICE AND METHODS

CROSS-REFERENCE TO RELATED APPLICATION

This application claims the benefit of U.S. provisional application No. 63/274,712, filed Nov. 2, 2021, the teaching of which is incorporated herein in its entirety by reference.

TECHNICAL FIELD OF THE DISCLOSURE

This disclosure generally relates to an elliptical crawler exercise device and methods of making and using the same.

BACKGROUND OF THE DISCLOSURE

Background information related to the present disclosure as described herein may not constitute prior art.

Personal home exercise is becoming popular in the covid-19 pandemic or post-pandemic era. Home exercise, however, is limited by space or constrained by available options. As such, there is a need for machines or devices that provide muscle strengthening training as well as cardio training.

The embodiments described below address such issues or problems.

SUMMARY OF THE DISCLOSURE

In one aspect of the present disclosure, it is provided an elliptical crawler, the elliptical crawler comprising:

a front support, an assembly of elliptical rowing body ("AERB"), and an optional back support, wherein the front support has a height dimension and angle that are adjustable to provide for programming of an exercise pattern by adjusting a horizontal/vertical level of body of a user, wherein the AERB comprises two extendible arm supports and two foot supports, wherein— one extendible arm support ("EAS") is placed on the left side of the AERB ("left EAS") and the other EAS is placed on the right side of the AERB ("right EAS"), one foot support ("FS") is placed on the left back side of the AERB ("left FS") and the other FS is placed on the right back side of the AERB ("right FS"), the left EAS and left FS are jointed with a left separation ("LS"), the left EAS, left FS and LS forming a left rowing part configured to row elliptically in sync, the right EAS and right FS are jointed with a right separation ("RS"), the right EAS, right FS and RS forming a right rowing part configured to row elliptically in sync, and the left rowing part and the right rowing part row elliptically in sync.

In some embodiments of the disclosed elliptical crawler, in combination with any or all the various embodiments disclosed herein, the two FSs each comprise a sleeve to receive feet of the user.

In some embodiments of the disclosed elliptical crawler, in combination with any or all the various embodiments disclosed herein, the elliptical crawler further comprises two support brackets, one support bracket ("SB") being placed on an outer middle position of the left separation of the AERB ("left SB") and the other FS being placed on an outer middle position of the right separation of the AERB ("right SB") such that when the crawler is in use, the user is placed between the left SB and the right SB, wherein the left SB and the right SB allow the user to hold onto the SB to stand up after a session of use ends.

In some embodiments of the disclosed elliptical crawler, in combination with any or all the various embodiments disclosed herein, the elliptical crawler further comprises a workout control unit configured to program a workout session, wherein the workout control unit is electronically connected to the assembly of elliptical rowing body, the front support, and optionally the left EAS and right EAS to provide a control of the workout session according to an input by the user of one or more parameters of the workout session, the one or more variables including speed of rolling, a level of resistance, the height dimension, and optionally a length of the left EAS and the right EAS.

In some embodiments of the disclosed elliptical crawler, in combination with any or all the various embodiments disclosed herein, the elliptical crawler further comprises a display panel to display the input of one or more variables by the user and output of a result summary of the workout session at the end of the workout session.

In some embodiments of the disclosed elliptical crawler, in combination with any or all the various embodiments disclosed herein, the workout control unit further comprises a networking unit configured to link-in two or more users of the elliptical crawler to undertake a competitive workout session.

In some embodiments of the disclosed elliptical crawler, in combination with any or all the various embodiments disclosed herein, the networking unit is configured to compare performances of the two or more users.

In another aspect of the present disclosure, it is provided a method of fabrication, comprising providing a design of an elliptical crawler, and forming the elliptical crawler, wherein the elliptical crawler comprises a front support, an assembly of elliptical rowing body, and an optional back support, wherein the front support has a height dimension and angle that are adjustable to provide for programming of an exercise pattern by adjusting a horizontal/vertical level of body of a user, wherein the AERB comprises two extendible arm supports and two foot supports, wherein— one extendible arm support ("EAS") is placed on the left side of the AERB ("left EAS") and the other EAS is placed on the right side of the AERB ("right EAS"), one foot support ("FS") is placed on the left back side of the AERB ("left FS") and the other FS is placed on the right back side of the AERB ("right FS"), the left EAS and left FS are jointed with a left separation ("LS"), the left EAS, left FS and LS forming a left rowing part configured to row elliptically in sync, the right EAS and right FS are jointed with a right separation ("RS"), the right EAS, right FS and RS forming a right rowing part configured to row elliptically in sync, and the left rowing part and the right rowing part row elliptically in sync.

In some embodiments of the disclosed method, in combination with any or all the various embodiments disclosed herein, the AERB is configured to provide for a resistance level that is adjustable.

In some embodiments of the disclosed method, in combination with any or all the various embodiments disclosed herein, the two FSs each comprise a sleeve to receive feet of the user.

In some embodiments of the disclosed method, in combination with any or all the various embodiments disclosed herein, the elliptical crawler further comprising two support brackets, one support bracket ("SB") being placed on an outer middle position of the left separation of the AERB ("left SB") and the other FS being placed on an outer middle position of the right separation of the AERB ("right SB") such that when the crawler is in use, the user is placed between the left SB and the right SB, wherein the left SB and the right SB allow the user to hold onto the SB to stand up after a session of use ends.

In some embodiments of the disclosed method, in combination with any or all the various embodiments disclosed herein, the elliptical crawler further comprising a workout control unit configured to program a workout session, wherein the workout control unit is electronically connected to the assembly of elliptical rowing body, the front support, and optionally the left EAS and right EAS to provide a control of the workout session according to an input by the user of one or more parameters of the workout session, the one or more variables including speed of rolling, a level of resistance, the height dimension, and optionally a length of the left EAS and the right EAS.

In some embodiments of the disclosed method, in combination with any or all the various embodiments disclosed herein, the elliptical crawler further comprises a display panel to display the input of one or more variables by the user and output of a result summary of the workout session at the end of the workout session.

In some embodiments of the disclosed method, in combination with any or all the various embodiments disclosed herein, the workout control unit further comprises a networking unit configured to link-in two or more users of the elliptical crawler to undertake a competitive workout session.

In some embodiments of the disclosed method, in combination with any or all the various embodiments disclosed herein, the networking unit is configured to compare performances of the two or more users.

In a further aspect of the present disclosure, it is provided a method of use, comprising using an elliptical crawler, wherein the elliptical crawler comprises a front support, an assembly of elliptical rowing body, and an optional back support, wherein the front support has a height dimension and angle that are adjustable to provide for programming of an exercise pattern by adjusting a horizontal/vertical level of body of a user, wherein the AERB comprises two extendible arm supports and two foot supports, wherein— one extendible arm support ("EAS") is placed on the left side of the AERB ("left EAS") and the other EAS is placed on the right side of the AERB ("right EAS"), one foot support ("FS") is placed on the left back side of the AERB ("left FS") and the other FS is placed on the right back side of the AERB ("right FS"), the left EAS and left FS are jointed with a left separation ("LS"), the left EAS, left FS and LS forming a left rowing part configured to row elliptically in sync, the right EAS and right FS are jointed with a right separation ("RS"), the right EAS, right FS and RS forming a right rowing part configured to row elliptically in sync, and the left rowing part and the right rowing part row elliptically in sync.

In some embodiments of the disclosed method, in combination with any or all the various embodiments disclosed herein, the AERB is configured to provide for a resistance level that is adjustable.

In some embodiments of the disclosed method, in combination with any or all the various embodiments disclosed herein, the two FSs each comprise a sleeve to receive feet of the user.

In some embodiments of the disclosed method, in combination with any or all the various embodiments disclosed herein, the elliptical crawler further comprising two support brackets, one support bracket ("SB") being placed on an outer middle position of the left separation of the AERB ("left SB") and the other FS being placed on an outer middle position of the right separation of the AERB ("right SB") such that when the crawler is in use, the user is placed between the left SB and the right SB, wherein the left SB and the right SB allow the user to hold onto the SB to stand up after a session of use ends.

In some embodiments of the disclosed method, in combination with any or all the various embodiments disclosed herein, the elliptical crawler further comprising a workout control unit configured to program a workout session, wherein the workout control unit is electronically connected to the assembly of elliptical rowing body, the front support, and optionally the left EAS and right EAS to provide a control of the workout session according to an input by the user of one or more parameters of the workout session, the one or more variables including speed of rolling, a level of resistance, the height dimension, and optionally a length of the left EAS and the right EAS.

In some embodiments of the disclosed method, in combination with any or all the various embodiments disclosed herein, the elliptical crawler further comprises a display panel to display the input of one or more variables by the user and output of a result summary of the workout session at the end of the workout session.

In some embodiments of the disclosed method, in combination with any or all the various embodiments disclosed herein, the workout control unit further comprises a networking unit configured to link-in two or more users of the elliptical crawler to undertake a competitive workout session.

In some embodiments of the disclosed method, in combination with any or all the various embodiments disclosed herein, the networking unit is configured to compare performances of the two or more users.

BRIEF DESCRIPTION OF THE DRAWINGS

FIG. 1 shows an embodiment of disclosed elliptical crawler.

FIG. 2 shows a further embodiment of the disclosed elliptical crawler where two of such crawlers are connected by digital networking.

DETAILED DESCRIPTION OF THE DISCLOSURE

Definitions

As used herein, the term "assembly of elliptical rowing body" refers to a machine that provides for elliptical rowing motions as used in popular elliptical trainers.

As used herein, the term "workout control unit" refers to a control unit that receives inputs from a user of a workout session and generates electronic signals to control the elliptical crawler of disclosure according to the inputs of a user to cause the elliptical crawler to have a motion of a pattern, duration, and a resistance level that the user selects or directs. Such a workout control unit is commonly used in workout machines, including elliptical trainers.

As used herein, the term "horizontal/vertical level" refers to a body level degree of a user of the disclosed elliptical crawler. A horizontal level is when the user has a body level that is flat (180°), and a vertical level is when the user has a body level that is vertical (90°). By adjusting the height and angle of the front support, a variety of body level degree of a user can be readily set and achieved.

Elliptical Crawler

In one aspect of the present disclosure, it is provided an elliptical crawler, the elliptical crawler comprising:

a front support, an assembly of elliptical rowing body, and an optional back support, wherein the front support has a height dimension and angle that are adjustable to provide for programming of an exercise pattern by adjusting a horizontal/vertical level of body of a user, wherein the AERB comprises two extendible arm supports and two foot supports, wherein— one extendible arm support ("EAS") is placed on the left side of the AERB ("left EAS") and the other EAS is placed on the right side of the AERB ("right EAS"), one foot support ("FS") is placed on the left back side of the AERB ("left FS") and the other FS is placed on the right back side of the AERB ("right FS"), the left EAS and left FS are jointed with a left separation ("LS"), the left EAS, left FS and LS forming a left rowing part configured to row elliptically in sync, the right EAS and right FS are jointed with a right separation ("RS"), the right EAS, right FS and RS forming a right rowing part configured to row elliptically in sync, and the left rowing part and the right rowing part row elliptically in sync.

In some embodiments of the disclosed elliptical crawler, in combination with any or all the various embodiments disclosed herein, the two FSs each comprise a sleeve to receive feet of the user.

In some embodiments of the disclosed elliptical crawler, in combination with any or all the various embodiments disclosed herein, the elliptical crawler further comprises two support brackets, one support bracket ("SB") being placed on an outer middle position of the left separation of the AERB ("left SB") and the other FS being placed on an outer middle position of the right separation of the AERB ("right SB") such that when the crawler is in use, the user is placed between the left SB and the right SB, wherein the left SB and the right SB allow the user to hold onto the SB to stand up after a session of use ends.

In some embodiments of the disclosed elliptical crawler, in combination with any or all the various embodiments disclosed herein, the elliptical crawler further comprises a workout control unit configured to program a workout session, wherein the workout control unit is electronically connected to the assembly of elliptical rowing body, the front support, and optionally the left EAS and right EAS to provide a control of the workout session according to an input by the user of one or more parameters of the workout session, the one or more variables including speed of rolling, a level of resistance, the height dimension, and optionally a length of the left EAS and the right EAS.

In some embodiments of the disclosed elliptical crawler, in combination with any or all the various embodiments disclosed herein, the elliptical crawler further comprises a display panel to display the input of one or more variables by the user and output of a result summary of the workout session at the end of the workout session.

In some embodiments of the disclosed elliptical crawler, in combination with any or all the various embodiments disclosed herein, the workout control unit further comprises a networking unit configured to link-in two or more users of the elliptical crawler to undertake a competitive workout session.

In some embodiments of the disclosed elliptical crawler, in combination with any or all the various embodiments disclosed herein, the networking unit is configured to compare performances of the two or more users.

FIG. 1 shows an embodiment of an elliptical crawler disclosed herein. In this embodiment, an elliptical crawler has a front support 100, an AERB 200, and an optional back support 300. The AERB 200 includes:

one extendible arm support ("EAS") 210*a* placed on the left side of the AERB 200 ("left EAS") and another EAS 210*b* placed on the right side of the AERB 200 ("right EAS"), one foot support ("FS") 220*a* placed on the left back side of the AERB 200 ("left FS") and another FS 220*b* placed on the right back side of the AERB 200 ("right FS"), the left EAS 210*a* and left FS 220*a* being jointed with a left separation ("LS") 230*a*, the left EAS 210*a*, left FS 220*a* and LS 230*a* forming a left rowing part that rows elliptically in sync, the right EAS 210*b* and right FS 220*b* being jointed with a right separation ("RS") 230*b*, the right EAS 210*b*, right FS 220*b* and RS 230*b* forming a right rowing part configured to row elliptically in sync, and the left rowing part and the right rowing part being configured to row elliptically in sync.

Referring still to FIG. 1, an embodiment of the disclosed elliptical crawler can include two support brackets, one support bracket ("SB") 240*a* that is placed on an outer middle position of the left separation 230*a* of the AERB 200 ("left SB"). SB 240*a* is joined with LS 230*a* via a support 241*a*. The other SB 240*b* (not shown) is placed on an outer middle position of the right separation 230*b* of the AERB 200 ("right SB"). SB 240*b* (not shown) is joined with RS 230*b* via a support 241*b* (not shown). When the crawler is in use, the user is placed between the left SB 240*a* and the right SB 240*b*; the left SB 240*a* and the right SB 240*b* are configured to allow the user to hold onto the SB 240*a* or SB 240*b* to stand up after a session of use ends.

Referring to FIG. 2, it provides a further embodiment of the disclosed elliptical crawler where two individual elliptical crawlers connected by digital networking 240*d*, each having a display panel 240*c*. The remaining parts and functions thereof of the elliptical crawler are as described in FIG. 1, the description of such, for concise description, is omitted.

Digital networking 240*d* can be based on any commercially available technologies, wired or wireless, for instance, Bluetooth, WiFi, or any other digital networking technology.

The elliptical crawler disclosed herein is advantageous over existing elliptical training machines in that it provides cardiovascular training as well as full body muscle strengthening training and can mimic a variety of physical activities by adjusting the horizontal/vertical level and the level of resistance of the elliptical crawler. For example, a high horizontal level can mimic cross-field crawling and a high vertical level can mimic mountain climbing or even rock climbing.

Methods of Fabrication

In another aspect of the present disclosure, it is provided a method of fabrication, comprising providing a design of an elliptical crawler, and forming the elliptical crawler, wherein the elliptical crawler comprises a front support, an assembly of elliptical rowing body, and an optional back support, wherein the front support has a height dimension and angle that are adjustable to provide for programming of an exercise pattern by adjusting a horizontal/vertical level of body of a user, wherein the AERB comprises two extendible arm supports and two foot supports, wherein— one extendible arm support ("EAS") is placed on the left side of the AERB ("left EAS") and the other EAS is placed on the right side of the AERB ("right EAS"), one foot support ("FS") is placed on the left back side of the AERB ("left FS") and the other FS is placed on the right back side of the AERB ("right FS"), the left EAS and left FS are jointed with a left separation ("LS"), the left EAS, left FS and LS forming a left rowing part configured to row elliptically in sync, the right EAS and right FS are jointed with a right separation ("RS"), the right EAS, right FS and RS forming a right rowing part configured to row elliptically in sync, and the left rowing part and the right rowing part row elliptically in sync.

In some embodiments of the disclosed method, in combination with any or all the various embodiments disclosed herein, the AERB is configured to provide for a resistance level that is adjustable.

In some embodiments of the disclosed method, in combination with any or all the various embodiments disclosed herein, the two FSs each comprise a sleeve to receive feet of the user.

In some embodiments of the disclosed method, in combination with any or all the various embodiments disclosed herein, the elliptical crawler further comprising two support brackets, one support bracket ("SB") being placed on an outer middle position of the left separation of the AERB ("left SB") and the other FS being placed on an outer middle position of the right separation of the AERB ("right SB") such that when the crawler is in use, the user is placed between the left SB and the right SB, wherein the left SB and the right SB allow the user to hold onto the SB to stand up after a session of use ends.

In some embodiments of the disclosed method, in combination with any or all the various embodiments disclosed herein, the elliptical crawler further comprising a workout control unit configured to program a workout session, wherein the workout control unit is electronically connected to the assembly of elliptical rowing body, the front support, and optionally the left EAS and right EAS to provide a control of the workout session according to an input by the user of one or more parameters of the workout session, the one or more variables including speed of rolling, a level of resistance, the height dimension, and optionally a length of the left EAS and the right EAS.

In some embodiments of the disclosed method, in combination with any or all the various embodiments disclosed herein, the elliptical crawler further comprises a display panel to display the input of one or more variables by the user and output of a result summary of the workout session at the end of the workout session.

In some embodiments of the disclosed method, in combination with any or all the various embodiments disclosed herein, the workout control unit further comprises a networking unit configured to link-in two or more users of the elliptical crawler to undertake a competitive workout session.

In some embodiments of the disclosed method, in combination with any or all the various embodiments disclosed herein, the networking unit is configured to compare performances of the two or more users.

Method of Use

In a further aspect of the present disclosure, it is provided a method of use, comprising using an elliptical crawler (FIG. 1), wherein the elliptical crawler comprises a front support, an assembly of elliptical rowing body, and an optional back support, wherein the front support has a height dimension and angle that are adjustable to provide for programming of an exercise pattern by adjusting a horizontal/vertical level of body of a user, wherein the AERB comprises two extendible arm supports and two foot supports, wherein— one extendible arm support ("EAS") is placed on the left side of the AERB ("left EAS") and the other EAS is placed on the right side of the AERB ("right EAS"), one foot support ("FS") is placed on the left back side of the AERB ("left FS") and the other FS is placed on the right back side of the AERB ("right FS"), the left EAS and left FS are jointed with a left separation ("LS"), the left EAS, left FS and LS forming a left rowing part configured to row elliptically in sync, the right EAS and right FS are jointed with a right separation ("RS"), the right EAS, right FS and RS forming a right rowing part configured to row elliptically in sync, and the left rowing part and the right rowing part row elliptically in sync.

In some embodiments of the disclosed method, in combination with any or all the various embodiments disclosed herein, the AERB is configured to provide for a resistance level that is adjustable.

In some embodiments of the disclosed method, in combination with any or all the various embodiments disclosed herein, the two FSs each comprise a sleeve to receive feet of the user.

In some embodiments of the disclosed method, in combination with any or all the various embodiments disclosed herein, the elliptical crawler further comprising two support brackets, one support bracket ("SB") being placed on an outer middle position of the left separation of the AERB ("left SB") and the other FS being placed on an outer middle position of the right separation of the AERB ("right SB") such that when the crawler is in use, the user is placed between the left SB and the right SB, wherein the left SB and the right SB allow the user to hold onto the SB to stand up after a session of use ends.

In some embodiments of the disclosed method, in combination with any or all the various embodiments disclosed herein, the elliptical crawler further comprising a workout control unit configured to program a workout session, wherein the workout control unit is electronically connected to the assembly of elliptical rowing body, the front support, and optionally the left EAS and right EAS to provide a control of the workout session according to an input by the user of one or more parameters of the workout session, the one or more variables including speed of rolling, a level of resistance, the height dimension, and optionally a length of the left EAS and the right EAS.

In some embodiments of the disclosed method, in combination with any or all the various embodiments disclosed herein, the elliptical crawler further comprises a display panel to display the input of one or more variables by the user and output of a result summary of the workout session at the end of the workout session.

In some embodiments of the disclosed method, in combination with any or all the various embodiments disclosed herein, the workout control unit further comprises a networking unit configured to link-in two or more users of the elliptical crawler to undertake a competitive workout session (FIG. 2).

In some embodiments of the disclosed method, in combination with any or all the various embodiments disclosed herein, the networking unit is configured to compare performances of the two or more users.

EXAMPLES

An example of the elliptical crawler was designed and made according to FIG. 1, described above.

While the present disclosure has been described in terms of preferred embodiments, it will be appreciated by one of ordinary skill that the spirit and scope of the disclosure is not limited to those embodiments, but extend to the various modifications and equivalents as defined in the appended claims.

Further, changes may be made in the construction, operation and arrangement of the various parts, elements, steps and procedures described herein without departing from the spirit and scope of the disclosure as described in the following claims.

I claim:

1. An elliptical crawler machine, comprising:

a front support, an assembly an elliptical rowing body AERB, and a selectively attachable back support, wherein the front support has a height dimension and an angle that are adjustable to provide for programming of an exercise pattern by adjusting a horizontal/vertical level of body of a user, wherein the AERB comprises two extendible arm supports and two foot supports, wherein:

one extendible arm support known as a left EAS of the two extendible arm supports is placed on a left side of the AERB and an other EAS known as a right EAS of the two extendible arm supports is placed on a right side of the AERB , one foot support known as a right FS of the two foot supports is placed on a right back side of the AERB and an other FS known as a right FS of the two foot supports is placed on a right back side of the AERB, the left EAS and left FS are jointed with a left separation LS, the left EAS, left FS and LS forming a left rowing part configured to row elliptically in sync, the right EAS and right FS are jointed with a right separation RS, the right EAS, right FS and RS forming a right rowing part configured to row elliptically in sync, and the left rowing part and the right rowing part row elliptically in sync.

2. The elliptical crawler of claim 1, wherein the AERB is configured to provide for a resistance level that is adjustable.

3. The elliptical crawler of claim 1, wherein the two FSs each comprise a sleeve configured to receive feet of the user.

4. The elliptical crawler of claim 1, further comprising two support brackets, one support bracket SB known as a left SB of the two support brackets being placed on an outer middle position of a left separation of the AERB and an other FS known as a right SB of the two support brackets being placed on an outer middle of a right separation of the AERB such that when the crawler is in use, the user is configured to be placed between the left SB and the right SB, wherein the left SB and the right SB allow the user to hold onto the SB to stand up after a session of use ends.

5. The elliptical crawler of claim 1, further comprising a workout control unit configured to program a workout session, wherein the workout control unit is electronically connected to the assembly of elliptical rowing body, the front support, and selectively to the left EAS and right EAS to provide a control of the workout session according to an input by the user of one or more variables of the workout session, the one or more variables including speed of rolling, a level of resistance, the height dimension, and a length of the left EAS and the right EAS.

6. The elliptical crawler of claim 5, further comprises a display panel to display the input of the one or more variables by the user and output of a result summary of the workout session at an end of the workout session.

7. The elliptical crawler of claim 5, wherein the workout control unit further comprises a networking unit configured to link-in two or more users of the elliptical crawler to undertake a competitive workout session.

8. The elliptical crawler of claim 7, wherein the networking unit is configured to compare performances of the two or more users.

9. A method of fabrication, comprising providing a design of an elliptical crawler, and forming the elliptical crawler, wherein the elliptical crawler comprises a front support, an assembly an elliptical rowing body AERB, and a selectively attachable back support, wherein the front support has a height dimension and an angle that are adjustable to provide for programming of an exercise pattern by adjusting a horizontal/vertical level of body of a user, wherein the AERB comprises two extendible arm supports and two foot supports, wherein:

one extendible arm support known as a left EAS of the two extendible arm supports is placed on a left side of the AERB and an other EAS known as a right EAS of the two extendible arm supports is placed on a right side of the AERB, one foot support known as a right FS of the two foot supports is placed on a right back side of the AERB and an other FS known as a right FS of the two foot supports is placed on a right back side of the AERB, the left EAS and left FS are jointed with a left separation LS, the left EAS, left FS and LS forming a left rowing part configured to row elliptically in sync, the right EAS and right FS are jointed with a right separation RS, the right EAS, right FS and RS forming a right rowing part configured to row elliptically in sync, and the left rowing part and the right rowing part row elliptically in sync.

10. The method according to claim 9, wherein the AERB is configured to provide for a resistance level that is adjustable.

11. The method according to claim 9, wherein the two FSs each comprise a sleeve configured to receive feet of the user.

12. The method according to claim 9, wherein the elliptical crawler further comprising two support brackets, one support bracket SB known as a left SB of the two support brackets being placed on an outer middle position of the left a left separation of the AERB and an other FS known as a right SB of the two support brackets being placed on an outer middle of a right separation of the AERB such that when the crawler is in use, the user is configured to be placed between the left SB and the right SB, wherein the left SB and the right SB allow the user to hold onto the SB to stand up after a session of use ends.

13. The method according to claim 9, wherein the elliptical crawler further comprising a workout control unit configured to program a workout session, wherein the workout control unit is electronically connected to the assembly of elliptical rowing body, the front support, and selectively to the left EAS and right EAS to provide a control of the workout session according to an input by the user of one or more variable of the workout session, the one or more variables including speed of rolling, a level of resistance, the height dimension, and a length of the left EAS and the right EAS.

14. The method according to claim 13, wherein the elliptical crawler further comprises a display panel to display the input of the one or more variables by the user and output of a result summary of the workout session at an end of the workout session.

15. The method according to claim 13, wherein the workout control unit further comprises a networking unit configured to link-in two or more users of the elliptical crawler to undertake a competitive workout session.

16. The method according to claim 15, wherein the networking unit is configured to compare performances of the two or more users.

17. A method of use, comprising using an elliptical crawler, the elliptical crawler comprising:

a front support, an assembly an elliptical rowing body AERB, and a selectively attachable back support, wherein the front support has a height dimension and an angle that are adjustable to provide for programming of an exercise pattern by adjusting a horizontal/vertical level of body of a user, wherein the AERB comprises two extendible arm supports and two foot supports, wherein:

one extendible arm support known as a left EAS of the two extendible arm supports is placed on a left side of the AERB and an other EAS known as a right EAS of the two extendible arm supports is placed on a right side of the AERB, one foot support known as a right FS of the two foot supports is placed on a right back side of the AERB and an other FS known as a right FS of the two foot supports is placed on a right back side of the AERB, the left EAS and left FS are jointed with a left separation LS, the left EAS, left FS and LS forming a left rowing part configured to row elliptically in sync, the right EAS and right FS are jointed with a right separation RS, the right EAS, right FS and RS forming a right rowing part configured to row elliptically in sync, and the left rowing part and the right rowing part row elliptically in sync.

18. The method according to claim 17, wherein the AERB is configured to provide for a resistance level that is adjustable.

19. The method according to claim 17, wherein the elliptical crawler further comprises a display panel to display an input of one or more variables by the user and an output of a result summary of the workout session at an end of the workout session.

20. The method according to claim 17, wherein the workout control unit further comprises a networking unit configured to link-in two or more users of the elliptical crawler to undertake a competitive workout session.

* * * * *